US012601579B2

(12) United States Patent
Chu et al.

(10) Patent No.: US 12,601,579 B2
(45) Date of Patent: Apr. 14, 2026

(54) AUTOMATIC UNCOUPLED CHARGING DEVICE AND METHOD

(71) Applicant: Shandong University of Technology, Zibo (CN)

(72) Inventors: Fujiao Chu, Zibo (CN); Yujia Tian, Weihai (CN); Jingtao Wang, Chifeng (CN); Yaoqing Chen, Jinan (CN); Jiani Wang, Linyi (CN); Siyang Lv, Kunming (CN); Zhangye Li, Chengdu (CN); Zhenyang Li, Huanggang (CN)

(73) Assignee: Shandong University of Technology, Zibo (CN)

( * ) Notice: Subject to any disclaimer, the term of this patent is extended or adjusted under 35 U.S.C. 154(b) by 0 days.

(21) Appl. No.: 18/766,865

(22) Filed: Jul. 9, 2024

(65) Prior Publication Data

US 2025/0020441 A1 Jan. 16, 2025

(30) Foreign Application Priority Data

Jul. 10, 2023 (CN) ..... 202310838304.4

(51) Int. Cl.
*F42D 1/10* (2006.01)

(52) U.S. Cl.
CPC ..... *F42D 1/10* (2013.01)

(58) Field of Classification Search
CPC ..... F42D 1/10; F42D 1/08; F42D 1/14; F42D 1/16; F42D 1/22
USPC ..... 86/20.15; 102/313, 302, 304, 324
See application file for complete search history.

(56) References Cited

U.S. PATENT DOCUMENTS 2,811,334 A * 10/1957 Charles ..... B66D 1/60 254/377
3,361,023 A * 1/1968 Collins ..... F42D 1/10 141/263
4,522,129 A * 6/1985 Jerberyd ..... F42D 1/10 254/134.6
8,826,821 B2 * 9/2014 Martin ..... F42B 3/087 102/331

FOREIGN PATENT DOCUMENTS

AU 2011223492 A1 * 9/2012 ..... F42D 1/10
KR 20230026082 A * 2/2023 ..... F42B 33/0207
KR 102732212 B1 * 11/2024 ..... F42D 1/24

* cited by examiner

*Primary Examiner* — John Cooper
(74) *Attorney, Agent, or Firm* — Hemisphere Law, PLLC

(57) ABSTRACT

An automatic uncoupled charging device includes a control system, a power system, a charging system, and an auxiliary system. The control system is equipped with a programmable circuit to control a screw speed. Explosives are charged into a container through manual handling or flowing from a mixed explosive vehicle. Explosive bags with different diameters are installed at the bottom of a discharge port. The device is set to start with one click, and the screw drives the explosive into the bag, achieving uncoupled charging. An automatic uncoupled charging method applying to the automatic uncoupled charging device not only reduces labor intensity, achieves fast charging, improves labor efficiency, but also achieves the goal of "mechanization reducing personnel", further advancing towards the essential safety of blasting construction.

9 Claims, 5 Drawing Sheets

AUTOMATIC UNCOUPLED CHARGING DEVICE AND METHOD

TECHNICAL FIELD

The disclosure relates to the field of blasting devices, and particularly to an automatic uncoupled charging device and method.

BACKGROUND

Contour control blasting has been widely used in open-pit mines, hydropower engineering, road and bridge engineering, and rock slope shaping related to geotechnical engineering, and has achieved good engineering results. But it adopts an uncoupled charging structure with low construction efficiency and high labor intensity. This structure mainly achieves uncoupled charging by bundling and placing powder rolls smaller than the diameter of the blast hole with bamboo sheets in the blast hole or by embedding polyvinyl chloride (PVC) pipes with fixed diameter in advance and sequentially stuffing the powder rolls into the pipes. This construction method has the disadvantages of a single type of explosive, high explosive cost, cumbersome construction steps, and a large number of labor personnel.

At present, there are few specialized charging devices that can achieve uncoupled charging structures on-site. Some products have disadvantages of simple device design, complex operation, and easy structural damage. More charging devices are often used by explosive factories to package bulk explosives. Loose explosives are rarely used in contour control blasting, and there are few types of coiled explosives for choosing. It is rare to use in-field mixed explosives for loading, which is difficult to adapt to complex and changing geological environments. In some construction, two or more types of explosives are also needed, which can easily lead to management confusion and safety accidents. In order to actively promote the goal of "mechanization replacing personnel, automation reducing personnel, and automatization reducing personnel", improve production quality and efficiency, and achieve the essential safety of engineering practice, mechanical devices capable of replacing manual operation are needed.

SUMMARY

The aim of the present disclosure is to provide an automatic uncoupled charging device to overcome the shortcomings of the above related art, and the automatic uncoupled charging device is capable of replacing manual operation, improving charging efficiency and production safety environment.

In order to achieve purposes above, the present disclosure provides solutions below.

The present disclosure provides an automatic uncoupled charging device including a container body, a controller, a power system, a charging system and an auxiliary system; the container body includes a container shell, a replaceable explosive bag holder, and a detachable explosive container; the detachable explosive container is located at a top of the container shell, two wire disks are respectively located at two sides of the top of the container shell; the replaceable explosive bag holder is located at a bottom of the container shell, an explosive bag is fixedly connected to a bottom of the replaceable explosive bag holder, and the explosive bag is connected to the two wire disks through pull ropes; and the power system includes a motor, a working condition of the motor is controlled by the controller; a power output end of the motor is in transmission connection to two horizontally arranged transmission rods through a gear; the two transmission rods are configured to drive the two wire disks to rotate; the charging system includes a screw, the replaceable explosive bag holder and the explosive bag; the screw is vertically connected to the power output end of the motor, and the screw is configured to transport explosives in the detachable explosive container from the replaceable explosive bag holder to the explosive bag; the auxiliary system includes a cooling structure and a telescopic tripod, the cooling structure is configured to cool the explosives in the container shell, and the telescopic tripod is configured to support the automatic uncoupled charging device.

In an embodiment, the container shell includes a feeding section in a shape of a trumpet at a top of the container shell and a cooling section in a shape of a cylinder at a bottom of the container shell; a top of the feeding section is threaded to the detachable explosive container, and a threaded interface at a bottom of the cooling section is threaded to the replaceable explosive bag holder.

In an embodiment, the cooling section includes an inner wall, an outer wall, and an interlayer configured for cooling liquid to flow located between the inner wall and the outer wall; and an inlet connecting to the interlayer and an outlet connecting to the interlayer are defined on the outer wall.

In an embodiment, the motor is externally equipped with a motor cover.

In an embodiment, the replaceable explosive bag holder is circular platform structure with different upper and lower diameters, and the bottom of the replaceable explosive bag holder is equipped with a hook configured to fix the explosive bag.

In an embodiment, the explosive bag is folded, bottom and top materials of the explosive bag are treated with increased density, a bottom of the explosive bag is connected to the two wire disks through the pull ropes, and the bottom of the explosive bag defines an opening capable of closing.

In an embodiment, the pull ropes are high-strength wires made of a multi-strand chemical fiber woven soaking adhesive material.

In an embodiment, the telescopic tripod includes three telescopic rods supporting between a ground and the detachable explosive container.

In an embodiment, the controller includes a display screen, buttons, a charging interface, an information transmission interface and a control circuit; the control circuit is located in a battery holder and a control panel; the battery holder and the controller are fixedly connected to a bottom periphery of the detachable explosive container, a battery is connected to the battery holder through a snapping groove, and battery pole pieces are conductive channels; and the controller is configured to control rotate speeds of the screw and the two wire disks through the control circuit.

The present disclosure also provides an automatic uncoupled charging method applying to the automatic uncoupled charging device, including:

S1, placing the automatic uncoupled charging device on a drill-hole, aligning a lower port of the cooling structure with the drill-hole; fixing, by the telescopic tripod, the automatic uncoupled charging device on a ground; and injecting cooling liquid into the cooling structure in advance;

S2, selecting the explosive bag with a proper diameter and the replaceable explosive bag holder, placing a detonator on a bottom of the explosive bag, and closing an opening of the explosive bag;

S3, fixing a top of the explosive bag to a hook, and fixing the bottom of the explosive bag to two ends of the two transmission rods through the two wire disks;

S4, placing explosives in the detachable explosive container, and operating buttons of the controller, achieving one click charging; and S5, moving the automatic uncoupled charging device to a corresponding position when charging a next drill-hole, and repeating the S4.

The present disclosure has following beneficial effects compared to the related art:

1. The automatic uncoupled charging device and the method provided by the present disclosure have the characteristic of a speed matching of a falling speed of the explosives and a falling speed of the explosive bag, and can achieve tight charging or normal charging through the speed matching, which is conducive to changing the density of the explosives and improving their performance. The acceleration of the falling speed of the explosives and the falling speed of the explosive bag can improve the charging efficiency and accelerate the operation speed.
2. The automatic uncoupled charging device and the method provided by the present disclosure can achieve one click automatic charging as long as one bag of explosives is placed into the detachable explosive container with one transfer by workers, greatly reducing labor intensity, simplifying the charging operation steps, reducing the number of the workers on the working face, and fundamentally improving the production safety environment.
3. The automatic uncoupled charging device and the method provided by the present disclosure do not utilize rolled explosives, but utilizes low-speed bulk explosives, which can achieve the on-site mixed explosive vehicle charging uncoupled structural drill-holes. This way is conducive to reducing the damage of blasting impact to the slope. By combining with the on-site mixed explosive vehicle, more types of explosives can be effectively applied in different engineering geological conditions.

BRIEF DESCRIPTION OF DRAWINGS

In order to provide a clearer explanation of embodiments of the present disclosure or the technical solutions in the related art, a brief introduction will be given to drawings required in the embodiments. Apparently, the drawings described below are only some embodiments of the present disclosure. For those skilled in the art, other drawings can be obtained based on these drawings without creative labor.

Figure 1:
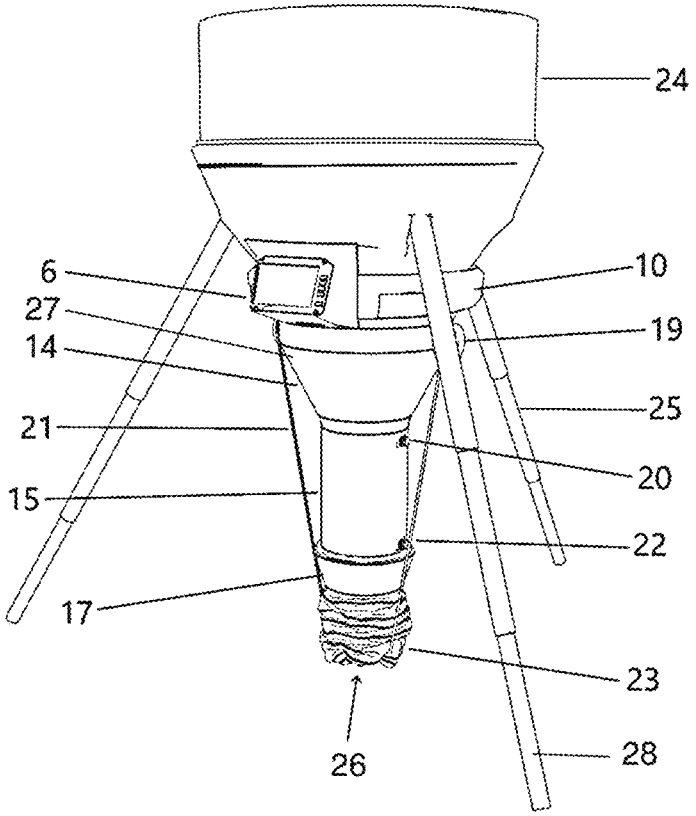
FIG. 1 illustrates a schematic diagram of the automatic uncoupled charging device according to an embodiment of the present disclosure.

Description of reference numerals: 1 motor cover; 2 motor; 3 transmission rod; 4 gear; screw; 6 display screen; 7 button; 8 charging interface; 9 information transmission interface; battery holder; 11 battery; 12 battery pole pieces; 13 snapping groove; 14 container shell; cooling section; 16 threaded interface; 17 replaceable explosive bag holder; 18 hook; 19 wire disk; 20 inlet; 21 pull rope; 22 outlet; 23 explosive bag; 24 detachable explosive container; 25 telescopic tripod; 26 opening; 27 feeding section; 28 telescopic rod; 29 interlayer; 30 inner wall; 31 outer wall.

DETAILED DESCRIPTION OF EMBODIMENTS

The following will provide a clear and complete description of the technical solution in embodiments of the present disclosure, in conjunction with drawings. Apparently, the described embodiments are only a part of the embodiments of the present disclosure, not all of them. Based on the embodiments in the present disclosure, all other embodiments obtained by those skilled in the art without creative labor fall within the scope of protection of the present disclosure.

The purpose of the present disclosure is to provide an automatic uncoupled charging device and a method to solve the problems existing in the related art.

In order to make the above objectives, features, and advantages of the present disclosure more explicit and understandable, further detailed explanations of the present disclosure will be provided below in conjunction with the drawings and embodiments.

Figure 2:
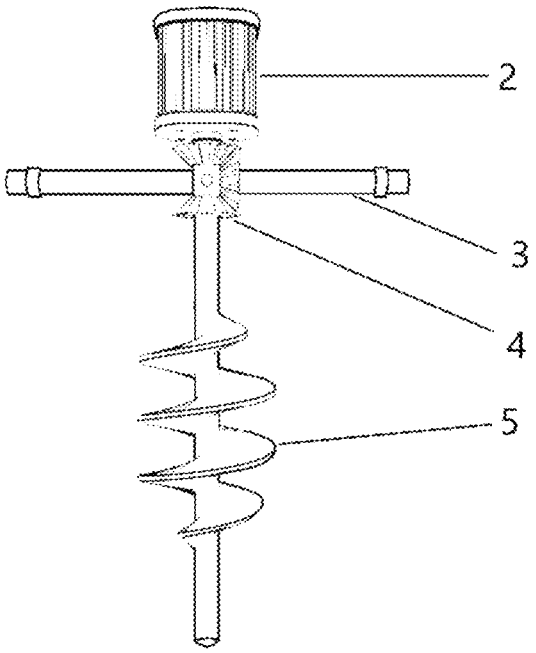
FIG. 2 illustrates an assembly drawing of a motor, transmission rods, and a screw according to the embodiment of the present disclosure.
Figure 3:
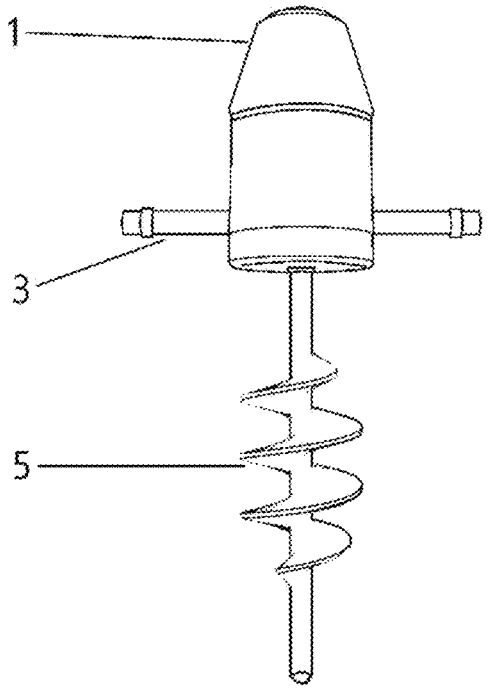
FIG. 3 illustrates a schematic diagram of the motor equipped with a motor cover according to the embodiment of the present disclosure.
Figure 4:
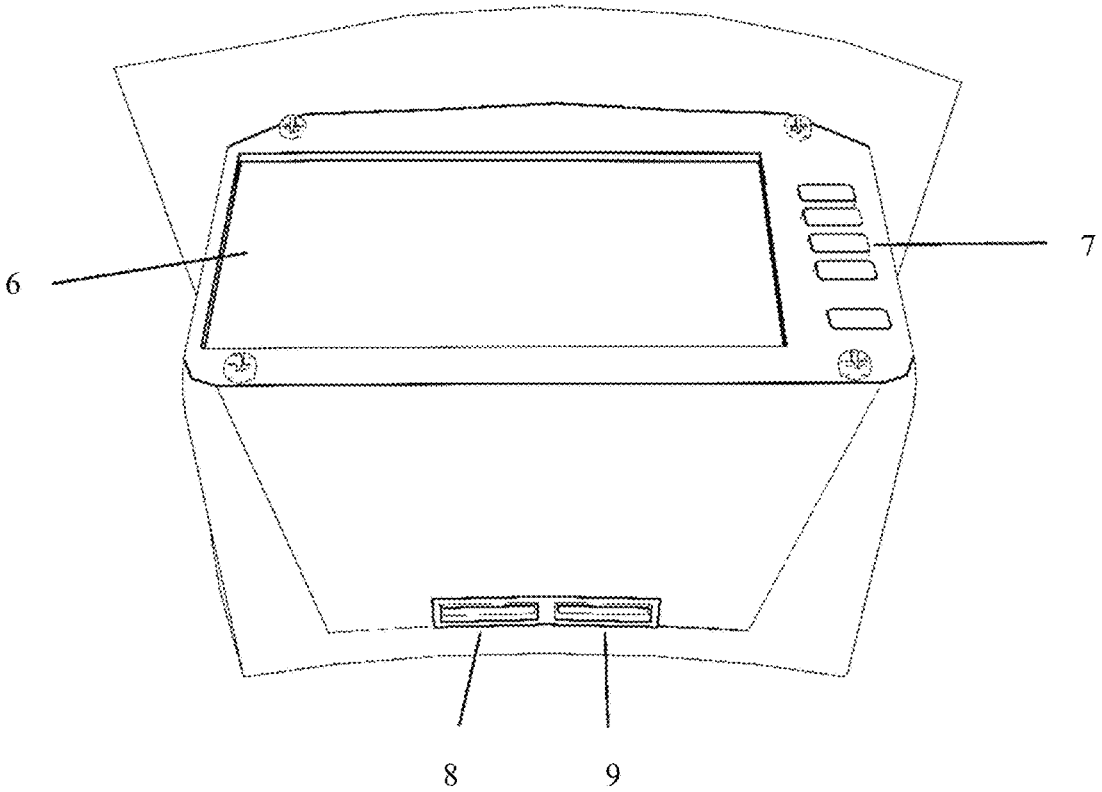
FIG. 4 illustrates a schematic diagram of a controller according to the embodiment of the present disclosure.
Figure 5:
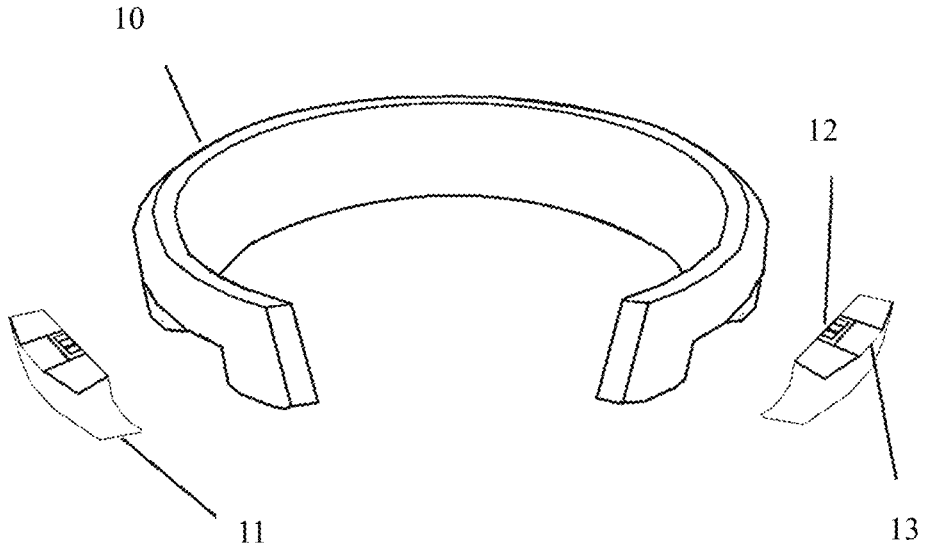
FIG. 5 illustrates a schematic diagram of a battery holder according to the embodiment of the present disclosure.
Figure 6:
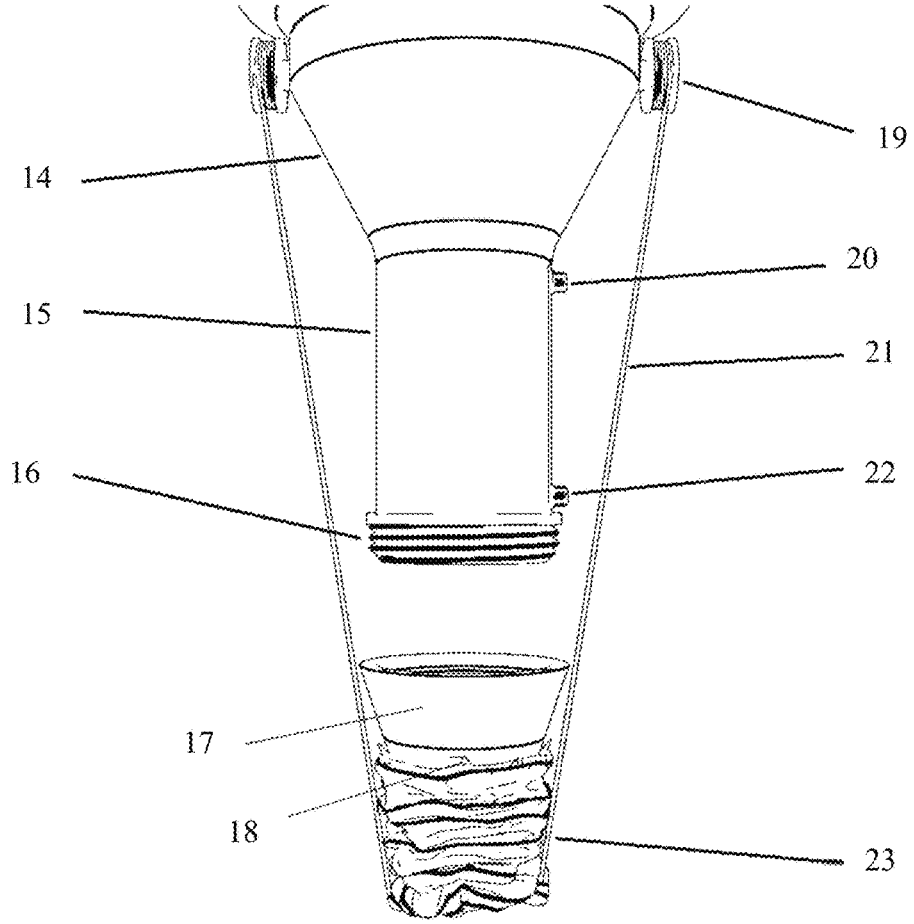
FIG. 6 illustrates an assembly drawing of a replaceable explosive bag holder and a cooling section according to the embodiment of the present disclosure.
Figure 7:
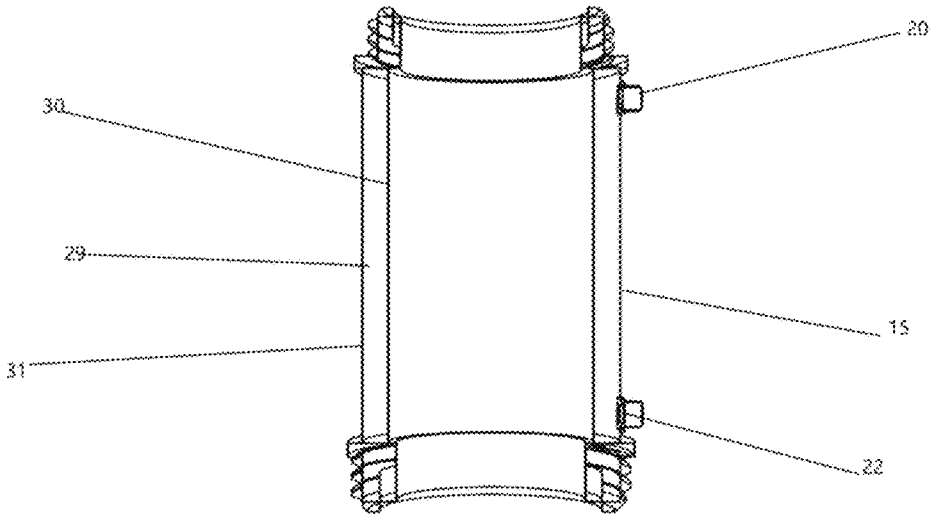
FIG. 7 illustrates a schematic diagram of a cooling section according to the embodiment of the present disclosure.
Figure 8:
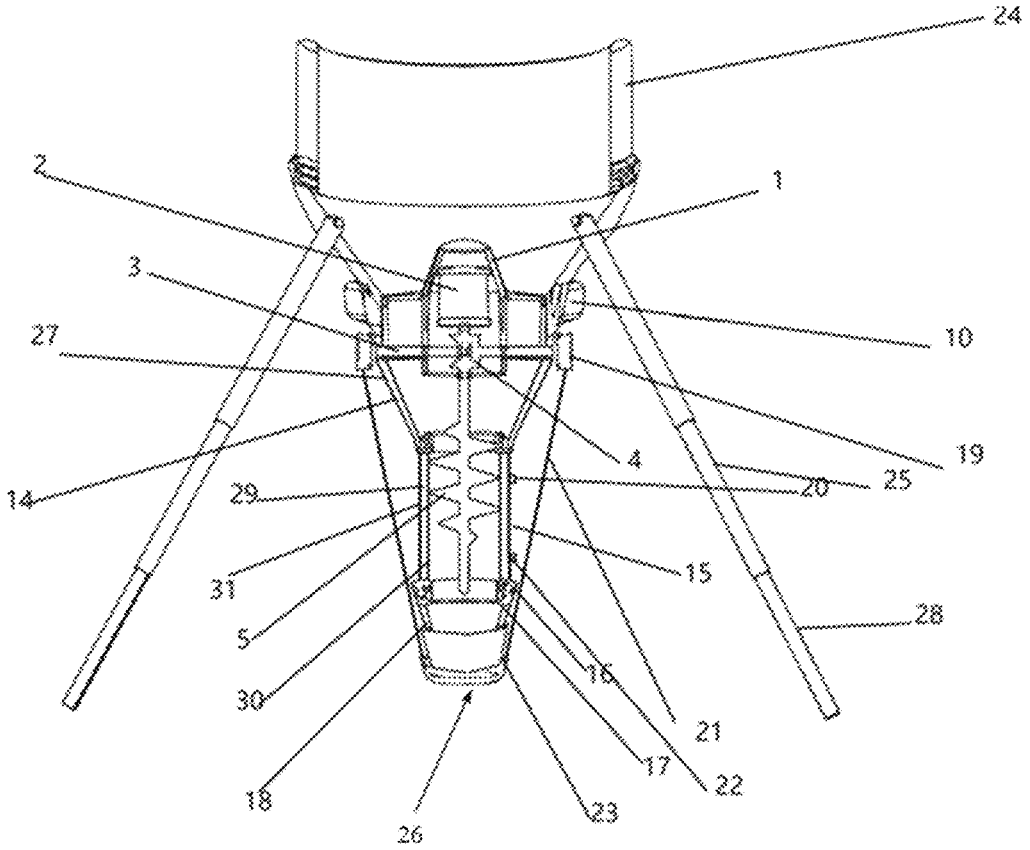
FIG. 8 illustrates a sectional view of the automatic uncoupled charging device according to the embodiment of the present disclosure.

As illustrated in FIGS. 1, 2, 3, 4, 5, 6 and 7, an embodiment provides an automatic uncoupled charging device, including a container body, a controller, a power system, a charging system and an auxiliary system. The container body includes a container shell 14, a replaceable explosive bag holder 17, and a detachable explosive container 24. The detachable explosive container 24 is located at a top of the container shell 14. Two wire disks 19 are respectively located at two sides of the top of the container shell 14. The replaceable explosive bag holder 17 is located at a bottom of the container shell 14. An explosive bag 23 is fixedly connected to a bottom of the replaceable explosive bag holder 17. The explosive bag 23 is connected to the two wire disks 19 through pull ropes 21.

The power system includes a motor 2. A working condition of the motor 2 is controlled by the controller. A power output end of the motor 2 is in transmission connection with two horizontally arranged transmission rods 3 through a gear 4. The two transmission rods 3 are configured to drive the two wire disks 19 to rotate. The charging system includes a screw 5, the replaceable explosive bag holder 17 and the explosive bag 23. The screw 5 is vertically connected to the power output end of the motor 2, and the screw 5 is configured to transport explosives in the detachable explosive container 24 from the replaceable explosive bag holder 17 to the explosive bag 23. The auxiliary system includes a cooling structure and a telescopic tripod 25. The cooling structure is configured to cool the explosives in an inner wall 30, and the telescopic tripod 25 is configured to support the automatic uncoupled charging device.

In an embodiment, the detachable explosive container 24 can hold a volume of 1.2 to 1.3 times a volume of a bag of bulk powdered explosives after installation. An optimal overall height design for the detachable explosive container 24 should not exceed 1 meter (m). An optimal thread angle for the screw 5 is 17°42', and an amount of explosives between the threads should meet a demand for discharging. The material for the screw 5 is brass.

In the embodiment, the container shell 14 includes a feeding section 27 in a shape of a trumpet at a top of the container shell and a cooling section 15 in a shape of a cylinder at a bottom of the container shell. A top of the feeding section 27 is threaded to the detachable explosive container 24, and a threaded interface 16 at a bottom of the cooling section 15 is threaded to the replaceable explosive bag holder 17. The cooling section 15 may be used as the cooling structure.

In the embodiment, the cooling section 15 includes the inner wall 30 and an outer wall 31, and an interlayer 29 for cooling liquid to flow located between the inner wall 30 and the outer wall 31. An inlet 20 connecting to the interlayer 29 and an outlet 22 connecting to the interlayer 29 are defined on the outer wall 31.

In the embodiment, the motor 2 is explosion-proof, and a motor cover 1 is installed outside the motor 2. The motor cover 1 is a closed structure that can prevent static electricity or high temperature of the motor 2 from affecting explosives, and can also block an entering of explosive powders and prevent the motor 2 from corroding.

In the embodiment, the replaceable explosive bag holder 17 is circular platform structure with different upper and lower diameters. The bottom of the replaceable explosive bag holder 17 is equipped with a hook 18 configured to fix the explosive bag 23. The explosive bag 23 is folded and placed, and bottom and top materials of the explosive bag 23 are treated with increased density. A bottom of the explosive bag 23 is connected to the two wire disks 19 through the pull ropes 21, and the bottom of the explosive bag 23 defines an opening 26 capable of closing. The pull ropes 21 are high-strength wires (also referred to as wires) made of a multi-strand chemical fiber woven soaking adhesive material.

In the embodiment, the telescopic tripod 25 includes three telescopic rods 28 supporting between a ground and the detachable explosive container 24.

In the embodiment, the controller includes a display screen 6, buttons 7, a charging interface 8, an information transmission interface 9 and a control circuit. The control circuit is located in a battery holder 10 and a control panel. The battery holder 10 and the controller are fixedly connected to a bottom periphery of the detachable explosive container 24. A battery 11 is connected to the battery holder 10 through a snapping groove 13. Battery pole pieces 12 are conductive channels. And the controller is configured to control rotate speeds of the screw 5 and the two wire disks 19 through the control circuit.

In an embodiment, the container shell 14 is a hollow structure. And materials except for the materials used for members mentioned above is steel.

The present disclosure also provides an automatic uncoupled charging method applying to the automatic uncoupled charging device including following steps S1 to S5.

S1, the automatic uncoupled charging device is placed on a drill-hole. A lower port of the cooling structure is aligned with the drill-hole. The automatic uncoupled charging device is fixed with a ground by the telescopic tripod 25. Cooling liquid is injected into a cooling system (also referred to as the cooling structure) in advance.

S2, the explosive bag 23 with a proper diameter and the replaceable explosive bag holder 17 are selected. A detonator is placed on a bottom of the explosive bag 23. And an opening 26 of the explosive bag is closed.

S3, a top of the explosive bag 23 is fixed to a hook 18, and the bottom of the explosive bag 23 is fixed to two ends of the two transmission rods 3 through the two wire disks 19.

S4, explosives are placed in the detachable explosive container 24. The buttons 7 of the controller are operated, achieving one click charging.

S5, the automatic uncoupled charging device is moved to a corresponding position when charging a next drill-hole, and the S4 is repeated.

The present disclosure applies specific embodiments to explain the principles and implementation methods of the present disclosure. The above embodiments are only used to help understand the methods and core ideas of the present disclosure. Meanwhile, for those skilled in the art, there may be changes in specific implementation methods and application scope based on the ideas of the present disclosure. In summary, the content of this specification should not be understood as a limitation of the present disclosure.

What is claimed is:

1. An automatic uncoupled charging device, comprising: a container body, a controller, a power system, a charging system and an auxiliary system;

wherein the container body comprises a container shell, a replaceable explosive bag holder, and a detachable explosive container; the detachable explosive container is located at a top of the container shell, two wire disks are respectively located at two sides of the top of the container shell; the replaceable explosive bag holder is located at a bottom of the container shell, an explosive bag is fixedly connected to a bottom of the replaceable explosive bag holder, and the explosive bag is connected to the two wire disks through pull ropes; and the power system comprises a motor, a working condition of the motor is controlled by the controller; a power output end of the motor is in transmission connection with two horizontally arranged transmission rods through a gear; the two transmission rods are configured to drive the two wire disks to rotate; the charging system comprises a screw, the replaceable explosive bag holder and the explosive bag; the screw is vertically connected to the power output end of the motor, and the screw is configured to transport explosives in the detachable explosive container from the replaceable explosive bag holder to the explosive bag; the auxiliary system comprises a cooling structure and a telescopic tripod, the cooling structure is configured to cool the explosives in the container shell, and the telescopic tripod is configured to support the automatic uncoupled charging device.

2. The automatic uncoupled charging device as claimed in claim 1, wherein the container shell comprises a feeding section in a shape of a trumpet at the top of the container shell and a cooling section in a shape of a cylinder at the bottom of the container shell; a top of the feeding section is threaded to the detachable explosive container, and a threaded interface at a bottom of the cooling section is threaded to the replaceable explosive bag holder.

3. The automatic uncoupled charging device as claimed in claim 2, wherein the cooling section comprises an inner wall, an outer wall, and an interlayer configured for cooling liquid to flow located between the inner wall and the outer wall; and an inlet connecting to the interlayer and an outlet connecting to the interlayer are defined on the outer wall.

4. The automatic uncoupled charging device as claimed in claim 1, wherein the motor is externally equipped with a motor cover.

5. The automatic uncoupled charging device as claimed in claim 1, wherein the replaceable explosive bag holder is a circular platform structure with different upper and lower diameters, and the bottom of the replaceable explosive bag holder is equipped with a hook configured to fix the explosive bag.

6. The automatic uncoupled charging device as claimed in claim 1, wherein the explosive bag is folded, bottom and top materials of the explosive bag are treated with increased density, a bottom of the explosive bag is connected to the two wire disks through the pull ropes, and the bottom of the explosive bag defines an opening capable of closing.

7. The automatic uncoupled charging device as claimed in claim 1, wherein the pull ropes are wires made of a multi-strand chemical fiber woven soaking adhesive material.

8. The automatic uncoupled charging device as claimed in claim 1, wherein the telescopic tripod comprises three telescopic rods supporting between a ground and the detachable explosive container.

9. The automatic uncoupled charging device as claimed in claim 1, wherein the controller comprises a display screen, buttons, a charging interface, an information transmission interface and a control circuit; the control circuit is located in a battery holder and a control panel; the battery holder and the controller are fixedly connected to a bottom periphery of the detachable explosive container, a battery is connected to the battery holder through a snapping groove, and battery pole pieces are conductive channels; and the controller is configured to control rotate speeds of the screw and the two wire disks through the control circuit.

* * * * *